US011828054B1

(12) United States Patent
Davoud et al.

(10) Patent No.: US 11,828,054 B1
(45) Date of Patent: Nov. 28, 2023

(54) INTERNALLY VENTILATED TOILET SYSTEMS AND METHODS OF USING THE SAME

(71) Applicants: Jeffrey G. Davoud, Midlothian, VA (US); Kaleb H. Davoud, Midlothian, VA (US); Kelan M. Davoud, Midlothian, VA (US)

(72) Inventors: Jeffrey G. Davoud, Midlothian, VA (US); Kaleb H. Davoud, Midlothian, VA (US); Kelan M. Davoud, Midlothian, VA (US)

( * ) Notice: Subject to any disclaimer, the term of this patent is extended or adjusted under 35 U.S.C. 154(b) by 0 days.

(21) Appl. No.: 18/098,976

(22) Filed: Jan. 19, 2023

(51) Int. Cl.
*E03D 9/05* (2006.01)

(52) U.S. Cl.
CPC ..... *E03D 9/05* (2013.01)

(58) Field of Classification Search
CPC ..... E03D 9/05; E03D 9/04; E03D 9/052
USPC ..... 4/209 R
See application file for complete search history.

(56) References Cited

U.S. PATENT DOCUMENTS

| | | | | |
|---|---|---|---|---|
| 1,122,264 | A | 12/1914 | Douglas | |
| 4,103,370 | A | 8/1978 | Arnold | |
| 4,344,194 | A | 8/1982 | Pearson | |
| 4,853,981 | A | 8/1989 | Hunnicutt, Jr. | |
| 6,298,500 | B1 * | 10/2001 | Sollami | A47K 13/307 4/217 |
| 6,550,072 | B1 | 4/2003 | Ware | |
| 6,772,449 | B1 * | 8/2004 | Wolfe | E03D 9/05 4/213 |
| 6,795,980 | B1 | 9/2004 | Ries | |
| 7,103,925 | B2 | 9/2006 | Toth | |
| 8,209,787 | B2 | 7/2012 | Rosswaag | |
| 8,789,213 | B2 | 7/2014 | Abunameh | |
| 9,756,996 | B1 * | 9/2017 | Ruiz | E03D 9/05 |
| 10,168,679 | B2 | 1/2019 | Tyson | |
| 10,302,318 | B1 | 5/2019 | Chambers | |
| 10,835,090 | B2 | 11/2020 | Payziev et al. | |
| 2008/0060119 | A1 | 3/2008 | Pinizzotto | |
| 2009/0235442 | A1 * | 9/2009 | Lee | E03D 9/052 4/217 |
| 2010/0235974 | A1 | 9/2010 | Reed | |
| 2011/0088156 | A1 | 4/2011 | White | |
| 2012/0227168 | A1 | 9/2012 | Paoluccio et al. | |
| 2012/0255110 | A1 * | 10/2012 | Kao | E03D 9/05 4/348 |
| 2017/0014009 | A1 * | 1/2017 | Smith | E03D 9/05 |

* cited by examiner

*Primary Examiner* — Huyen D Le
(74) *Attorney, Agent, or Firm* — RYAN ALLEY IP

(57) ABSTRACT

A commode has a suctioning exhaust to capture and remove gasses and any other fluids harboring waste. A pressurizing element may maintain around a 0.01-inch water column or more negative pressure airflow into the bowl and out of the vent. The suctioned air can be communicated outside a space having the toilet and waste to prevent any inhabitant or user from interacting with the same. Suction may be taken at any point and at any level, including shutting off or increasing suction at desired times or in response to detected use. A moveable lid and/or seat to the toilet may close the same by rotation and carry a portion of the suctioned exhaust. Systems are useable with existing plumbing and ventilation systems.

16 Claims, 2 Drawing Sheets

INTERNALLY VENTILATED TOILET SYSTEMS AND METHODS OF USING THE SAME

BACKGROUND

Undesired odors and sounds are associated with human defecation and other waste activities, including the use of toilets in indoor plumbing. Moreover, pathogens have been associated with circulating particulate matter generated through these activities. Air fresheners are well known for use in combination with human waste elimination. Air fresheners are typically a strong aromatic substance that circulates easily within a washroom or water closet containing the toilet, to mask scents emanating the from the toilet. Additionally, washrooms and lavatories may use ventilation to carry away undesired smells and partially mask sounds. For example, in-room vents, potentially with fans or other pressurized air flow, may remove or circulate air from a room to remove unwanted odors associated with toilet use. Such vents are commonly located in the ceiling of a bathroom, common room, or water closet, at least 8-10 feet away from the toilet and source of odors. While toilets may include a powered or suctioning flusher that pulls waste matter down out of a sewage exit of the toilet, offensive odors typically enter, and are potentially pulled to the ventilation, well before flush in the washroom or lavatory. Further, the flush is of limited duration and insufficient air volume to recapture all air and odors carried therein.

This background provides a useful baseline or starting point from which to better understand some example embodiments discussed below. Except for any clearly-identified third-party subject matter, likely separately submitted, this Background and any figures are by the Inventor(s), created for purposes of this application. Nothing in this application is necessarily known or represented as prior art.

SUMMARY

Example embodiment systems sanitize and increase environmental pleasantness of bathrooms, water closets, lavatories, and other waste disposal areas by preventing or reducing airborne circulation of gaseous, liquid, and particulate matter from waste. Example systems include a toilet with a vent connected to a drive and outlet to capture and remove air contaminated with waste from the toilet. Because of the enclosed and relatively smaller size of the bowl, suction venting, apart from any flushing of the bowl, may prevent escape of airborne odors and remove this air to a safe and non-offensive disposal area. Disease-control and sanitation-standard levels of removal are possible from the bowl, such as by maintaining around a 0.01-inch water column or more negative pressure airflow from the suction venting. The suctioned air can be carried continuously and directly to an external capture or exhaust point, such that inhabitants of the room or environment surrounding the toilet may not encounter the air and its contaminants. The vent may be positioned to suction at any point from the bowl, including through apertures in a bottom of a seat of the toilet. The airflow driven by negative pressure may be started or increased in response to detected toilet usage or preparation for use, through a sensor detecting the same. For example, movement, pressure, or heat sensors may detect a human sitting or about to sit on the seat, or a remote switch operated by the user may indicate imminent use, and the drive may activate to commence or increase negative air pressure from the bowl.

BRIEF DESCRIPTIONS OF THE DRAWINGS

Example embodiments will become more apparent by describing, in detail, the attached drawings, wherein like elements are represented by like reference numerals, which are given by way of illustration only and thus do not limit the example embodiments herein.

DETAILED DESCRIPTION

Figure 1:
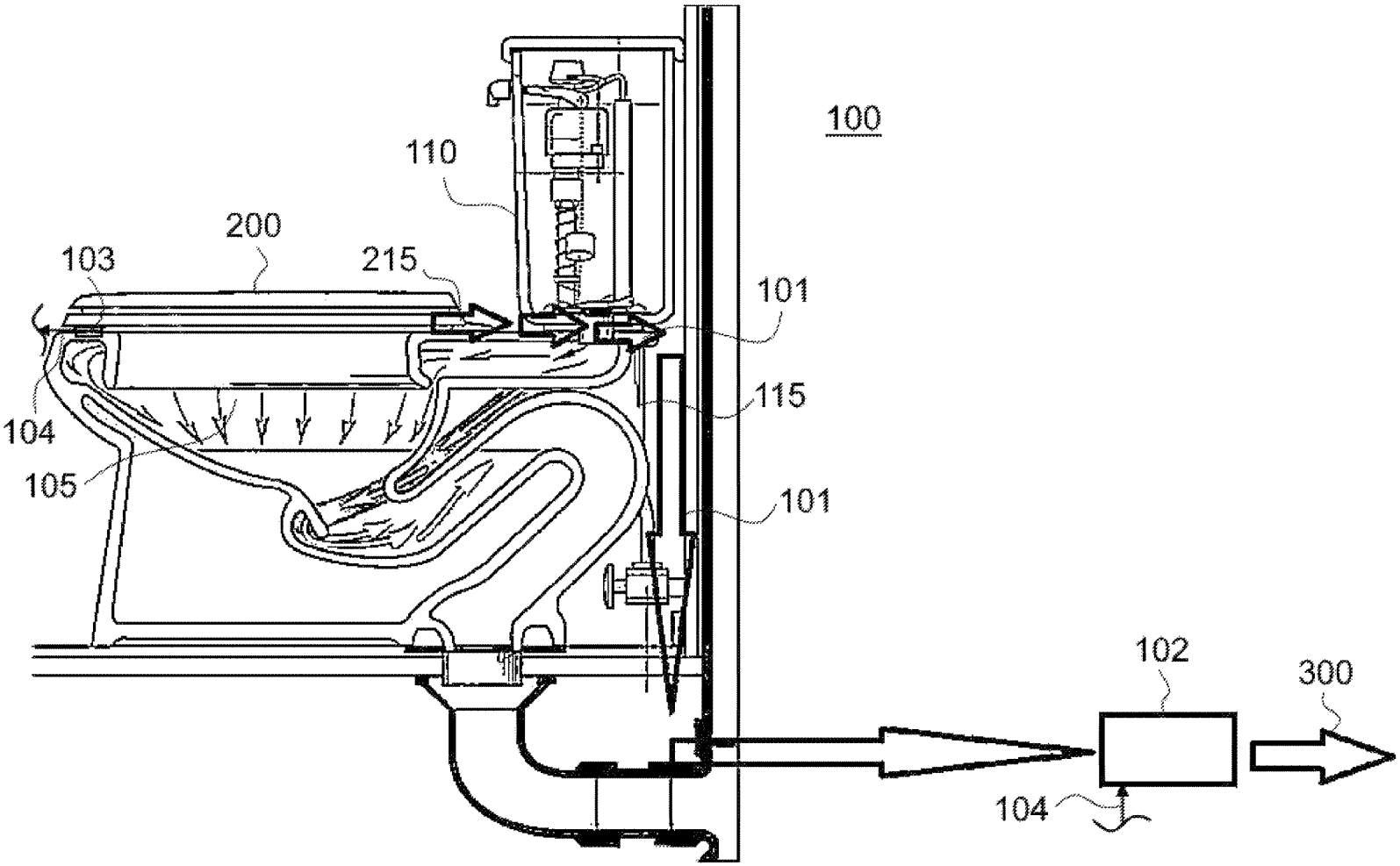
FIG. 1 is an illustration of an example embodiment toilet ventilation system

Because this is a patent document, general broad rules of construction should be applied when reading it. Everything described and shown in this document is an example of subject matter falling within the scope of the claims, appended below. Any specific structural and functional details disclosed herein are merely for purposes of describing how to make and use examples. Several different embodiments and methods not specifically disclosed herein may fall within the claim scope; as such, the claims may be embodied in many alternate forms and should not be construed as limited to only examples set forth herein.

Membership terms like "comprises," "includes," "has," or "with" reflect the presence of stated features, characteristics, steps, operations, elements, and/or components, but do not themselves preclude the presence or addition of one or more other features, characteristics, steps, operations, elements, components, and/or groups thereof. Rather, exclusive modifiers like "only" or "singular" may preclude presence or addition of other subject matter in modified terms. The use of permissive terms like "may" or "can" reflect optionality such that modified terms are not necessarily present, but absence of permissive terms does not reflect compulsion. In listing items in example embodiments, conjunctions and inclusive terms like "and," "with," and "or" include all combinations of one or more of the listed items without exclusion of non-listed items.

The use of "etc." is defined as "et cetera" and indicates the inclusion of all other elements belonging to the same group of the preceding items, in any "and/or" combination(s). Modifiers "first," "second," "another," etc. do not confine modified items to any order. These terms are used only to distinguish one element from another; where there are "second" or higher ordinals, there merely must be that many number of elements, without necessarily any difference or other relationship among those elements.

When an element is related, such as by being "connected," "coupled," "on," "attached," "fixed," etc., to another element, it can be directly connected to the other element, or intervening elements may be present. In contrast, when an element is referred to as being "directly connected," "directly coupled," etc. to another element, there are no intervening elements present. Other words used to describe the relationship between elements should be interpreted in a like fashion (e.g., "between" versus "directly between," "adjacent" versus "directly adjacent," etc.).

As used herein, singular forms like "a," "an," and the are intended to include both the singular and plural forms, unless the language explicitly indicates otherwise. Indefinite articles like "a" and "an" introduce or refer to any modified term, both previously-introduced and not, while definite articles like "the" refer to the same previously-introduced term. Relative terms such as "almost" or "more" and terms of degree such as "approximately" or "substantially" reflect 10% variance in modified values or, where understood by the skilled artisan in the technological context, the full range of imprecision that still achieves functionality of modified terms. Precision and non-variance are expressed by contrary terms like "exactly."

The structures and operations discussed below may occur out of the order described and/or noted in the figures. For example, two operations and/or figures shown in succession may in fact be executed concurrently or may be executed in the reverse order, depending upon the functionality/acts involved. Similarly, individual operations within example methods described below may be executed repetitively, individually or sequentially, so as to provide looping or other series of operations aside from exact operations described below. It should be presumed that any embodiment or method having features and functionality described below, in any workable combination, falls within the scope of example embodiments.

The inventors have recognized external ventilation systems and air fresheners do not eliminate odors and airborne waste from circulating outside of a toilet in use. Further, any flushing mechanism is operated too late and without sufficient air removal to ensure the surrounding environment is not contaminated by smells, sounds, and/or particulate material escaping from a toilet during use. There is thus a need for ventilation that prevents escape from a toilet throughout use, for health and sanitation as well as human comfort. To overcome these newly-recognized problems as well as others, the inventors have developed example embodiments and methods described below to address these and other problems recognized by the Inventors with unique solutions enabled by example embodiments.

The present invention is toilet systems having a vent operable independent from any flushing of the toilet and methods of installing and operating the same. In contrast to the present invention, the few example embodiments and example methods discussed below illustrate just a subset of the variety of different configurations that can be used as and/or in connection with the present invention.

FIG. 1 is an illustration of an example embodiment toilet ventilation system 100. As shown in FIG. 1, system 100 includes toilet 115 having bowl 105 connected to a sewage outlet and drain for holding and eliminating waste with conventional plumbing. Toilet 115 may be any style or type of toilet, including a tank-type toilet having back tank 110 holding a flushing device and reservoir for flush control. Of course, tankless, powered, dual-flush, pressure-assisted, composting, waste disposal, chemical, and/or any other type of toilet is useable in example embodiments. Similarly, additional toilet features such as air fresheners, cleaners, bidet sprays, drying fans, etc. are all useable in toilet 115 or as separate features in system 100.

Example embodiment system 100 includes vent 101 connecting an interior of bowl 105 to external disposal 300. Because vent 101 opens directly into or is in close fluid communication with bowl 105 where waste is deposited, odors and other airborne matter from bowl 105 may be directly and/or readily flowed into vent 101 without circulating outside of toilet 115 or into a containing room, such as a public restroom, common lavatory, private power room etc. In this way, example embodiment system 100 may greatly reduce or prevent smell, particulate matter, infection vectors, and other undesired waste offput from escaping toilet 115 and becoming airborne in the surrounding environment during use. For example, vent 101 may be a continuous tube or line that opens only about bowl 105 and disposal 300 to ensure no escape or interaction of the carried air or other fluids with contaminants. Vent 101 may ultimately connect with external disposal 300 distinct from an output or sewage line from the toilet carrying waste. For example, external disposal 300 may be an outside vent line, air filtration system, ventilation system, etc. that disposes of air and all other matter suctioned from bowl 105 and carried by vent 101, potentially without significant human interaction.

Vent 101 may open directly into, or be in fluid communication with, bowl 105 in any manner in toilet 115. For example, vent 101 may directly open into bowl 105 about a top edge where water is jetted into bowl 105, or vent 101 may open at a water line in bowl 105. Or for example, vent 101 may open in a tube protruding into bowl 105. Or, for example, vent 101 may open through apertures in an underside of example embodiment seat 200 above bowl 105. It is understood that vent may thus open at any point in toilet 115 about bowl 105 to suction airflow from bowl 105 that may contain odoriferous or airborne waste matter.

Vent 101 passes through or about a body of toilet 115 to ultimately connect with external disposal 300 such that air and odor from bowl 105 cannot flow from bowl 105 into a room or other ambient environment housing toilet 115. For example, vent 101 may pass down through a body of toilet 115 from bowl 105 to a ground-level exhaust connection running to a roof vent or ventilation system as external disposal 300. Or, for example, vent 101 may be a tube that runs through or under tank 110 from seat 200 into an air-return duct of an HVAC system as external disposal 300 about toilet 115. Or, for example, vent 101 may flow directly into a sewer system, tank, or main that can receive air as external disposal 300.

Pump 102 is connected to vent 101 to draw air and odor from bowl 105 into vent 101 and out to external disposal 300. For example, pump 102 may be an air pump, compressor, fan, blower, pneumatic drive, jet pump, and/or any device that can drive and/or suction fluid flow through vent 101. In this way pump 102 may prevent air and odor from escaping from bowl 105 through negative pressure and/or airflow relative to the environment ambient to toilet 115. Pump 102 may be internal to toilet 115, such as in a body of the same about vent 101. Similarly, pump 102 may be external, such as in a wall or as a part of a ventilation system to which vent 101 connects. Pump 102 may be locally powered, such as through a battery, or connected to a local or remote power source, such as a wall outlet or hard-wired into a building power supply.

Vent 101 and pump 102 may have adequate openings into bowl 105, flowpath size, and power to create and maintain negative pressure and/or airflow from bowl 105 and ultimately the ambient room containing toilet 115. For example, vent 101 and pump 102 may draw airflow to maintain about 0.01-0.03 inches of water column (inches WC) relative negative pressure with respect to the ambient environment. Even a 0.01 WC differential may prevent substantially all air outflow from the suctioned area, consistent with sanitation standards for preventing spread of airborne pathogens out of an infection area or quarantine. In this way, example embodiment system 100 may prevent any odor from escaping bowl 105 as well as any other airborne material that may pose an offensive or health risk. Further, any airflow noise generated by vent 101 sucking air from bowl 105 may provide relaxing white noise and/or aid in obscuring or drowning out noises associated with toilet use.

Pump 102 may be active and generating airflow from bowl 105 throughout operation, independent of, and potentially well before, any user flushes toilet 105 or even begins use of the same. Similarly, pump 102 may start or increase airflow in response to toilet use while reducing or not operating during non-use, to conserve energy and prevent air loss. For example, sensor 103 may detect when toilet 115 is in use or about to be used and generate signal 104 in communicative connection with pump 102. Pump 102 may begin or increase operation in response to use indicated by signal 104 and may decrease or cease operation in response to non-use indicated by signal 104.

For example, sensor 103 may be a pressure-activated switch, transducer, heat sensor, water level sensor, motion sensor, chromotographic/spectrometric air monitor, optical sensor, lid/seat position sensor. and/or any other type of detector that detects presence of a user on seat 200, disposal of waste into bowl 105, a user standing or moving near toilet 115, and/or any other indicia of imminent or ongoing use. Upon detecting presence and/or toilet usage, signal 104 may cause pump 102 to begin or increase operation. For example, upon detecting a human sitting on seat 200 by pressure sensor 103, or detecting elevated scatole or another indole in ambient air of bowl 105 by chemical air monitor 103, or the breaking of a beam in laser sensor 103 indicating a lid has been raised, etc. pump 102 may increase operation from 0.01 WC to 0.03 WC negative airflow in system 100. Similarly, when signal 104 indicates non-detection by sensor 103, pump 102 may deactivate or revert to 0.01 WC for example.

Pump 102 and vent 101 may prevent backflow into bowl 105, such as through a check-valve, to ensure that captured air is delivered only to disposal 300. Pump 102 may automatically shut off in response to detection of low or no air flow, or excess negative pressure, through vent 101, to prevent suction injury to any user or damage to pump 102. Pump 102 may also be operated by manual operation, such as a dial or switch on a power source of the same, to operate in accordance with user input.

Figure 2A:
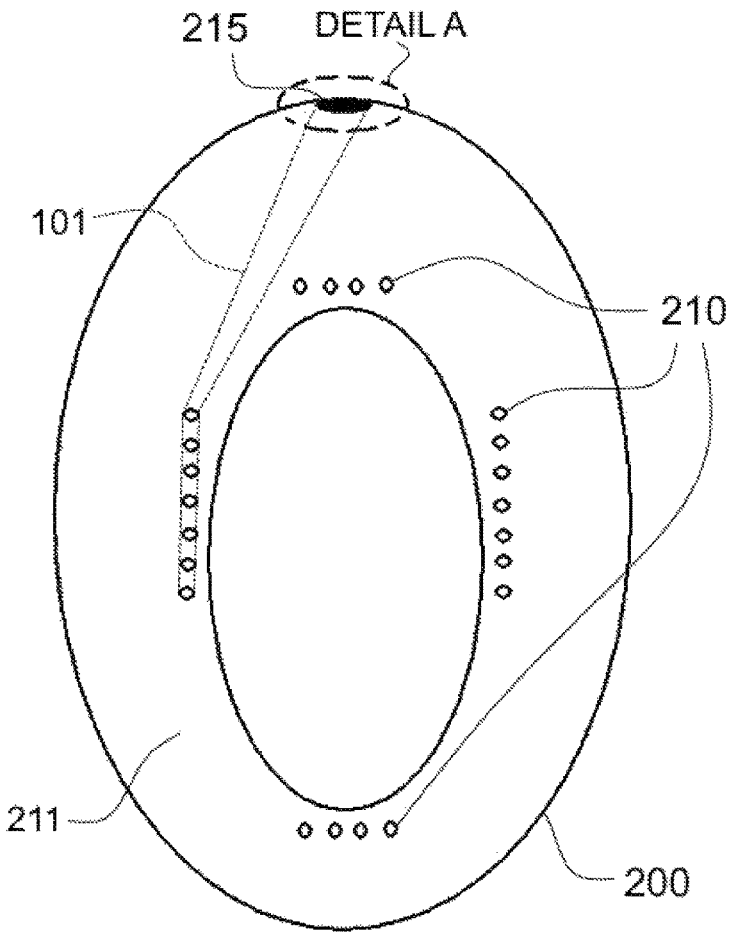
FIG. 2A is an illustration of an example embodiment toilet seat useable in example embodiments.
Figure 2B:
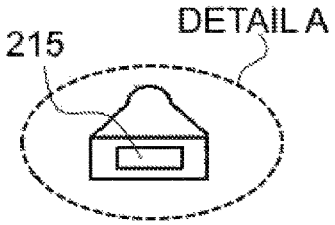
FIG. 2B is a detail of the example embodiment seat shown in FIG. 2A.

FIGS. 2A and 2B are illustrations of an example embodiment seat 200 useable in example embodiment system 200, as an example of vent 101 (FIG. 1) that passes through a moveable seat. As shown in FIG. 2A, seat 200 may include several apertures 210 positioned on underside 211 of seat 200. Apertures 210 may be in any number, position, and configuration to provide desired airflow in example embodiment system 100. For example, apertures 210 may be arranged evenly around four sides of a central opening to evenly pull airflow from a bowl below underside 211 when in use. Multiple apertures 210 may ensure continues air draw even if a few become clogged by water or solid matter.

Apertures 210 may connect to vent 101 as a channel inside seat 200 that exits through a back exhaust 215. As shown in FIG. 2B, back exhaust 215 may be perpendicular to apertures 210 or facing horizontal, to properly direct airflow in a rearward direction with clearance for connection and flow in the instance that seat 200 is rotated or moved. An external tube or channel internal to toilet 115 (FIG. 1), for example, may connect to exhaust 215 as a continuation of vent 101 external disposal 300 (FIG. 1). Any pump, sensor, and/or power source to create or control airflow may be internal to seat 200 or otherwise on vent 101. Although not shown in FIG. 2A, example embodiment seat 200 may include any other typical toilet seat features, including connection hinges, lid, heaters, bidet attachments, etc.

Example embodiment seat 200 may be installed at any point, potentially separate from installation of toilet 115. If vent 101 is external to toilet 115, system 100 may be operable simply by installing seat 200 and connecting vent 101 to external disposal 300 and optionally any power source for pump 102 to achieve example embodiment system 100. Similarly, vent 101 being internal to toilet 115 may be useable simply by connecting back exhaust 215 to vent 101 in toilet 115 while installing seat 200. Of course, other non-seat configurations for vent 101 are useable in example embodiment system 100, which require only installation of vent 101 pulling airflow from bowl 105 to external disposal 300 with pump 102. Example embodiment system 200 is otherwise installable with existing or new plumbing like any toilet, such as by installing the toilet to a building's sewer drain and connecting vent 101 to an HVAC return line or exhaust line in the room.

Some examples described here, it is understood that one or more examples may be used in combination and/or repetitively to produce multiple options and functionalities for venting of toilets without external airflow. Example methods and embodiments thus being described, it will be appreciated by one skilled in the art that example embodiments may be varied through routine experimentation and without further inventive activity. Variations are not to be regarded as departure from the spirit and scope of the exemplary embodiments, and all such modifications as would be obvious to one skilled in the art are intended to be included within the scope of the following claims.

What is claimed is:

1. A method of sanitizing areas housing a toilet, the method comprising:

suctioning air from a bowl of a toilet with a vent opening directly into the bowl, wherein the suctioning air maintains at least about 0.01-inch water column negative pressure in the bowl relative to the areas;

exhausting the suctioned air to a disposal connected to the vent outside of the areas, wherein the disposal is separate from a sewage pipe receiving waste flushed from the toilet; and detecting, with a sensor, that the toilet is in use or about to be used, wherein the suctioning air is performed in response to the detecting, and wherein the suctioning increases the negative pressure in the bowl to about 0.03-inch water column negative pressure so as to prevent substantially all air outflow from the bowl and provide sanitization to the areas.

2. The method of claim 1, wherein the suctioning air is performed independently of a user flushing the toilet.

3. The method of claim 1, wherein the sensor is at least one of a pressure sensor and a seat position sensor on the toilet.

4. The method of claim 1, wherein the suctioning is performed by a pump connected to the vent, and wherein the vent passes through a wall or floor about the toilet with no openings in the areas except into the bowl.

5. The method of claim 1, further comprising:

discontinuing the suctioning air in response to non-use of the toilet or lack of air flow through the vent.

6. The method of claim 1, wherein the vent opens into the bowl through a plurality of apertures on a bottom side of a seat of the toilet, and wherein the vent passes through the seat and through a body of the toilet to connect directly from the body to a boundary of the area.

7. The method of claim 1, further comprising:

emptying the bowl of the toilet including waste in the bowl by flushing the bowl contents down the sewage pipe, wherein the suctioning and the exhausting are continuous before the emptying.

8. A system for sanitizing areas subject to defecation, the system comprising:

a toilet having a bowl with a sewage outlet, wherein the bowl is configured to hold waste and flush waste through the sewage outlet;

a vent opening to the bowl;

a disposal connected to the bowl by the vent and separate from the sewage outlet;

a pump on the vent configured to suction air from the bowl to the disposal; and a sensor paired with the toilet and communicatively connected to the pump, wherein the pump is configured to suction air in response to a signal from the sensor that the toilet is in use or about to be used, wherein the pump is configured to increase a negative pressure in the bowl from 0.01-inch to about 0.03-inch water column negative pressure in response to the signal so as to prevent substantially all air outflow from the bowl and provide sanitization to the areas.

9. The system of claim 8, wherein the vent and pump are configured to maintain at least about 0.01-inch water column negative pressure in the bowl relative to the area.

10. The system of claim 8, wherein the sensor is a pressure sensor.

11. The system of claim 8, wherein the pump is configured to discontinue suctioning air in response to non-use of the toilet or lack of air flow through the vent.

12. The system of claim 8, wherein the vent passes through a body of the toilet to connect directly to a wall or floor about the toilet from the body with no openings in the area except into the bowl.

13. The system of claim 8, further comprising:

a seat connected to the toilet above the bowl, wherein the vent opens to the bowl through a plurality of apertures on a bottom side of a seat of the toilet, and wherein the vent passes through the seat.

14. The system of claim 13, wherein the seat further includes a lid configured to rotate open and shut above the bowl, the system further comprising:

a sensor connected to the seat and communicatively connected to the pump, wherein the pump is configured to suction air in response to a signal from the sensor that the seat is in use.

15. The system of claim 13, wherein the plurality of apertures are arranged on at least three sides of an opening in the seat.

16. The system of claim 13, wherein the vent includes a tube connected to an exhaust of the seat.

* * * * *